United States Patent [19]

La Hue

[11] Patent Number: 4,781,203

[45] Date of Patent: Nov. 1, 1988

[54] METHOD AND APPARATUS FOR MAKING SELF-EXTINGUISHING CIGARETTE

[76] Inventor: Paul D. La Hue, 1137 Linden Dr., Bloomington, Ind. 47401

[21] Appl. No.: 734,118

[22] Filed: May 15, 1985

[51] Int. Cl.[4] ..... A24C 5/18; A24D 1/10

[52] U.S. Cl. ..... 131/79; 131/284; 131/31; 131/62; 131/84.1; 131/349

[58] Field of Search ..... 131/349, 284, 79, 31, 131/62, 84.1

[56] References Cited

U.S. PATENT DOCUMENTS

| | | | |
|---|---|---|---|
| 1,726,737 | 9/1929 | Harris | 131/349 |
| 1,999,223 | 4/1935 | Weinberger | 131/349 |
| 1,999,224 | 4/1935 | Miles | 131/349 |
| 2,013,508 | 9/1935 | Seaman | 131/349 |
| 2,329,927 | 9/1943 | Morton | 131/349 |
| 2,543,277 | 2/1951 | Copeman | 131/63 |
| 2,836,183 | 5/1958 | Fay et al. | 131/349 |
| 3,030,963 | 4/1962 | Cohn | 131/349 |
| 3,183,914 | 5/1965 | Cohn | 131/349 |
| 3,220,418 | 11/1965 | Cohn | 131/349 |
| 3,525,343 | 8/1970 | Wiles, Jr. | 131/349 |
| 3,913,590 | 10/1975 | Sway | 131/349 |
| 4,044,778 | 8/1977 | Cohn | 131/349 |
| 4,146,040 | 3/1979 | Cohn | 131/349 |
| 4,230,131 | 10/1980 | Simon | 131/349 |
| 4,319,587 | 3/1982 | Moser | 131/349 |
| 4,409,995 | 10/1983 | Nichols | 131/79 |

*Primary Examiner*—V. Millin

*Attorney, Agent, or Firm*—Woodard, Emhardt, Naughton Moriarty & McNett

[57] ABSTRACT

A cigarette making apparatus for making self-extinguishing cigarettes including an electromagnetically actuated spray nozzle for directing a solution of sodium silicate onto a stream of tobacco at predetermined intervals such that when the stream of tobacco is formed into a continuous cigarette rod and the rod is cut into individual cigarettes, the sodium silicate treated portion of the tobacco stream will fall at the midpoint of each finished cigarette.

8 Claims, 4 Drawing Sheets

METHOD AND APPARATUS FOR MAKING SELF-EXTINGUISHING CIGARETTE

BACKGROUND OF THE INVENTION

1. Field of the Invention

This invention pertains generally to the field of cigarettes and automatic cigarette making machines and processes, and more particularly to an improved cigarette which is self-extinguishing, and to an improvement to cigarette making machines and processes enabling the mass production of self-extinguishing cigarettes.

2. Description of the Related Art

It has long been recognized that cigarettes are dangerous articles due to the poisonous and carcinogenic fumes they emit, and due to the fire hazard they present when carelessly discarded. Consequently, the related art includes a variety of proposals for diminishing one or the other, or both, of these dangers.

One approach is to provide some means for preventing a cigarette from being smoked beyond a certain minimum butt length. A simple solution is shown in U.S. Pat. No. 4,319,587, issued Mar. 16, 1982 to Moser, wherein spaced visual indicia are provided on the cigarette body marking the point at which the cigarette should be discarded. More positively effective means for halting burning of the cigarette at a selected point are shown in U.S. Pat. Nos. 2,013,508, issued Sept. 3, 1935 to Seaman, and 3,913,590, issued Oct. 21, 1975 to Sway. Seaman provides a fire retarding band on the cigarette wrapper at one-half to three-quarters the length of the cigarette. The band is formulated to extinguish the cigarette at that point, if it has been discarded. If one continues to draw on the cigarette, however, it will continue burning beyond the band. Sway provides his cigarette with a nonflammable porous barrier comprised of a plug of diatomaceous earth, permitting free passage of smoke therethrough, but preventing combustion beyond the porous barrier.

Cigarette making machines configured to produce self-extinguishing cigarettes are also shown in the related art, examples being U.S. Pat. Nos. 1,999,223 to Weinberger, and 1,999,224 to Miles, both issued Apr. 30, 1935. Both of these patents describe machines directed toward providing the cigarette wrapping paper, immediately prior to the tobacco-filling and cigarette rolling operation, with a transversely oriented coating of agglutinating substance, to which particles of the tobacco adhere during the filling operation to provide in the finished cigarette an annular, combustion-retarding band of tobacco particles.

SUMMARY OF THE INVENTION

An apparatus for making self-extinguishing cigarettes includes means for continuously gathering and arranging shredded tobacco particles into a substantially uniform moving stream of tobacco and means for providing a continuous strip of cigarette wrapping paper. Also provided are means for continuously receiving the moving stream of tobacco and the continuous strip of cigarette wrapping paper and combining and shaping them into a continuous cigarette rod. Means for receiving the continuous cigarette rod and cutting the cigarette rod into individual cigarettes are also included. Further provided are a supply of liquid and means, in flow communication with the supply of liquid, for intermittently directing the flow of the liquid onto the moving stream of tobacco. Means for synchronizing the intermittent flow means with the cigarette cutting means such that the liquid is applied at intervals and for a selected duration so that the portion of the tobacco stream to which the liquid is applied ends up at a selected place along the length of each cut cigarette are also included.

A cigarette which is self extinguishing at a selected point along its length includes a rod of tobacco particles including a treated region intermediate the ends thereof at a selected point. The length of the treated region is substantially less than the length of the rod of tobacco particles, and the treated region includes therein a fire retardant chemical. A paper wrapper is disposed about the rod of tobacco particles.

It is an object of the present invention to provide an improved cigarette making apparatus and method particularly suited for high speed mass production of self-extinguishing cigarettes.

It is a further object of the present invention to provide an improved cigarette which is self extinguishing at a selected point along it length, yet which is simple and inexpensive to manufacture and which smokes as an ordinary cigarette prior to extinguishing.

Further objects and advantages of the present invention will become apparent from the following description.

DESCRIPTION OF THE PREFERRED EMBODIMENT

Figure 1:
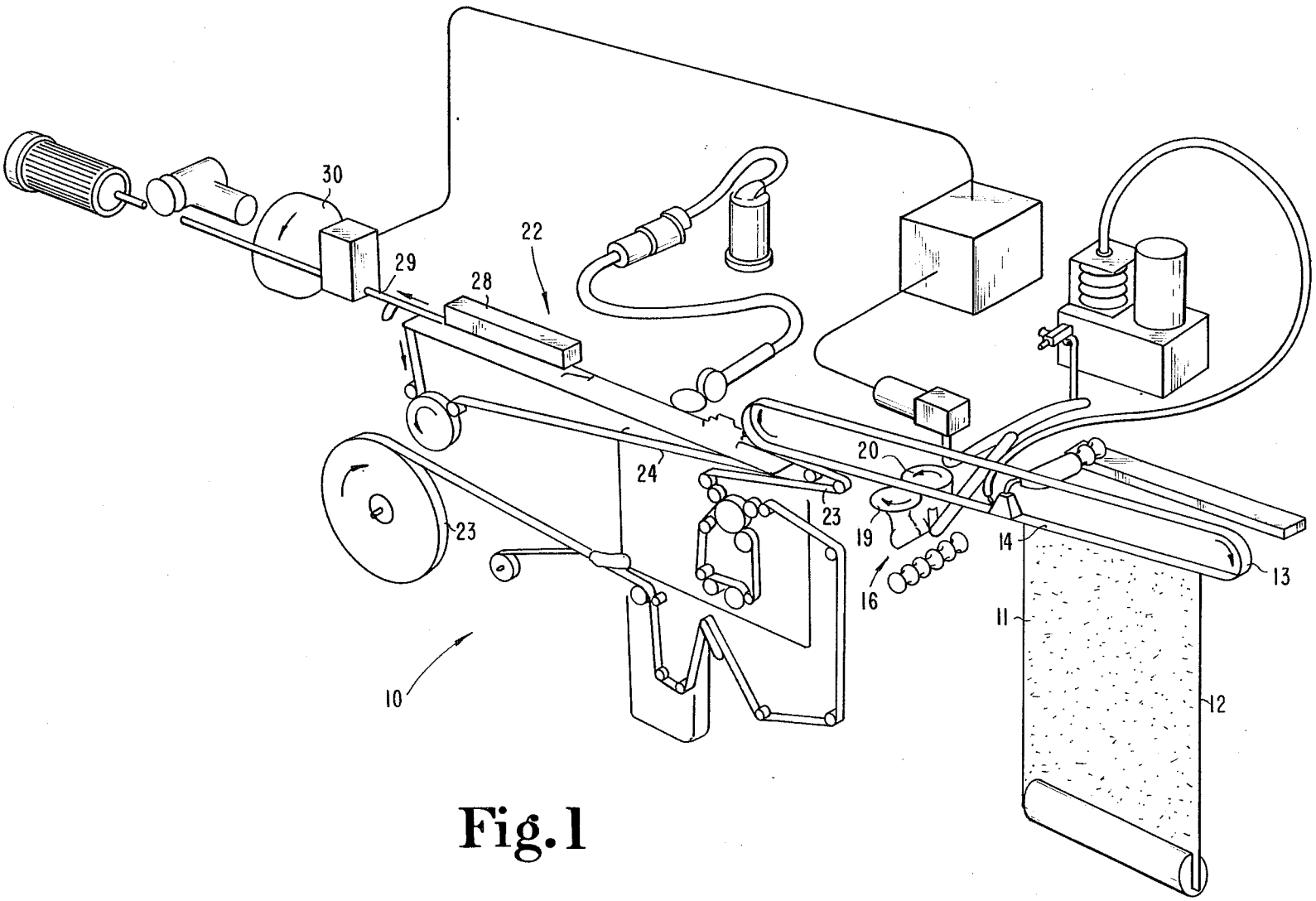
FIG. 1 is a simplified perspective view of a cigarette making apparatus for making self extinguishing cigarettes in accordance with the present invention.
Figure 2:
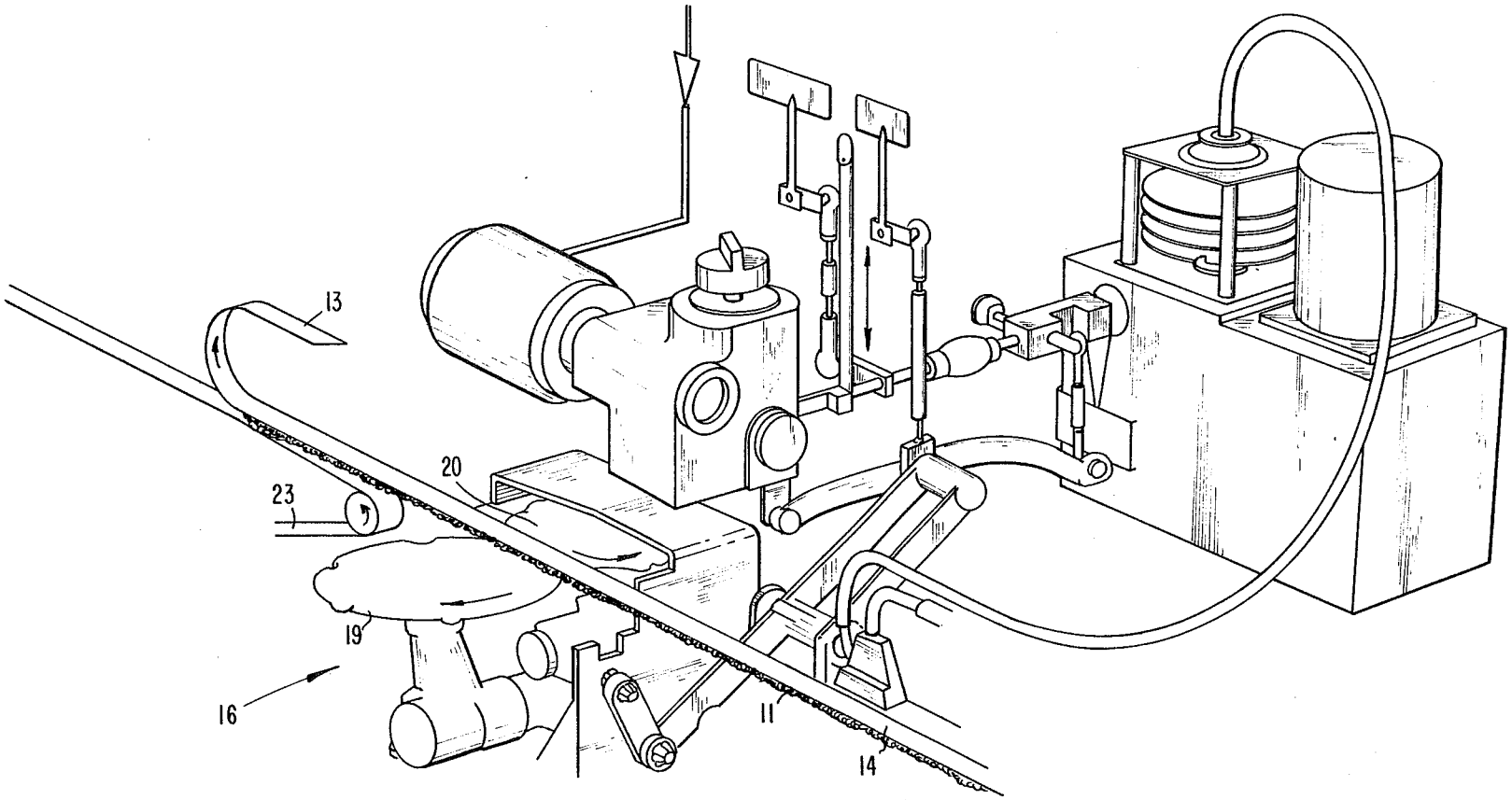
FIG. 2 is a close-up simplified perspective view of the tobacco treatment location of the apparatus of FIG. 1.

For the purpose of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Referring in particular to FIG. 1, there is illustrated a cigarette making apparatus 10 which has been particularly adapted in accordance with the present invention for making self-extinguishing cigarettes. Apparatus 10 is in large part conventional and known, being adapted from a commercially available automated cigarette making apparatus manufactured by Molins of the United Kingdom. There follows a brief description of the major components of apparatus 10 and the sequence of events which result in the production of a finished cigarette having self extinguishing properties.

In apparatus 10 the cigarette making process begins with properly shredded and graded tobacco particles 11 passing from a hopper (not shown) upwards through chimney 12 in a column of rising air. The rising tobacco particles 11 are captured and held by air pressure to the underside of a perforated stainless steel suction band 13. Suction band 13 is a continuous loop mounted about rotatable end pulleys such that the lower portion 14 of suction band 13 moves continuously to the left as indicated by the arrows. Means are provided for applying negative air pressure (suction) to the top side of the lower portion 14 of suction band 13 so that the captured tobacco particles 11 are held to the bottom side of suction band 13 and are thereby transported to the left as suction band 13 rotates on its supporting end pulleys.

Figure 3:
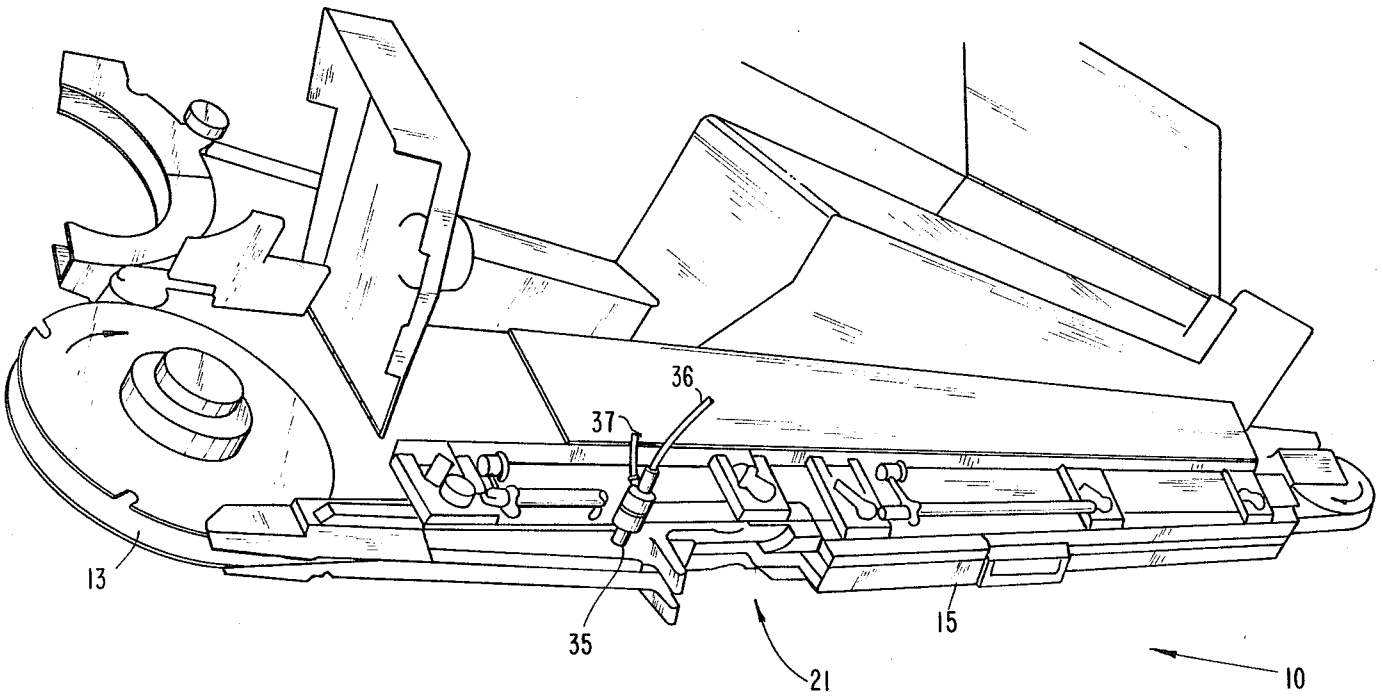
FIG. 3. is a very close perspective view of the tobacco treatment location of the apparatus of FIG. 1, and particularly showing the location of the applicator.

Lower portion 14 of suction band 13 rides in the top of a stainless steel trough 15 (shown best in FIG. 3). Trough 15 is closed at the bottom as it leaves chimney 12, forming an enclosed tunnel through which the tobacco is transported. The tobacco is transported along the underside of suction band 13 through trough 15 toward correction area 16.

In correction area 16 the depth of the tobacco on the underside of the suction band is monitored and continuously corrected by means of two counter-rotating ecreteur discs 19 and 20, which are disposed within an opening 21 in trough 15. Ecreteur disks 19 and 20 are made to rise to trim off excess tobacco, or alternatively, to lower to leave more tobacco on suction band 13, thus assuring that a uniform amount of tobacco enters the following garniture area continuously. Excess tobacco trimmed off by ecreteur disks 19 and 20 is returned to the hopper via a spiral screw and vibrating tray (not shown).

The trimmed tobacco on the underside of suction band 13 continues to move to the left past ecreteur disks 19 and 20 toward the garniture 22. The tobacco combines with the cigarette paper 23 at the entrance to the garniture 22. The tobacco is stripped from the suction band and falls onto the moving cigarette paper 23 which enters from underneath the trough 15. The paper and tobacco are supported by and carried to the left by an endless garniture tape 24. A garniture tongue (not shown) compresses the tobacco which then passes through the folder section 28 where adhesive is applied to the cigarette paper and the paper and tobacco are formed into a continuous cigarette rod 29 which emerges from the left end of the folder section 28.

A rotating knife 30 operates in synchrony with the garniture mechanism to cut cigarette rod 29 into individual cigarettes of uniform length.

The above described elements and sequence of operation of apparatus 10 is conventional and known, and commercially available. It has been described here to provide a background for understanding the improvement which comprises the present invention, one embodiment thereof including a modification of the above described apparatus and process which can be easily implemented on existing cigarette making machinery to enable high speed mass production of self-extinguishing cigarettes.

Figure 5:
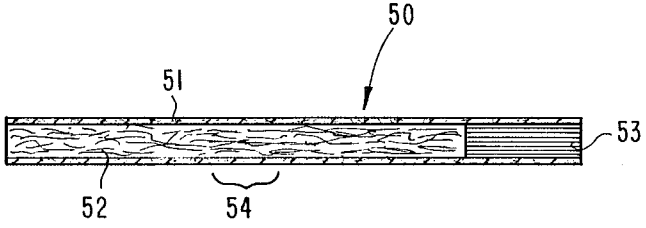
FIG. 5 is a longitudinal sectional view of a self extinguishing cigarette in accordance with the present invention, particularly showing the treated area of the tobacco rod.

A cigarette can be made to be self-extinguishing at a selected point along its length by treating a small portion of the tobacco rod at the selected point with a fire retardant chemical, resulting in a cigarette as shown in FIG. 5. Cigarette 50 is mostly of conventional construction. Included are tubular paper wrapper 51, which is wrapped about a rod of tobacco particles 52 and a filter 53. The filter 53 is in no way necessary to the practice of the present invention, but is shown as being typical of modern cigarettes. An area 54 of the tobacco 52, being about 3–5 cm in length, is saturated with a fire retardant chemical applied in liquid form, which then dries leaving a cigarette which looks and smokes entirely conventionally until the combustion reaches the treated area 54. For cosmetic reasons, it is preferred that the fire retardant be applied to the tobacco rod 52 before the paper wrapper 51 is applied.

The preferred fire retardant is an aqueous solution of sodium silicate, also known as water glass. After drying, the sodium silicate treated area of the tobacco remains porous to tobacco smoke and does not interfere with the normal smoking properties of the cigarette until the combustion reaches the treated area. At that point, the heat of the burning tobacco causes the sodium silicate to fuse and the cigarette extinguishes itself. By selecting the treated portion of the cigarette tobacco to be at approximately the midpoint of the length of the cigarette, the smoker avoids smoking the portion of the cigarette tobacco proximate the butt end which has theretofore acted as a filter and which is therefore laden with concentrated tars and other noxious and unhealthful substances. A fire safety advantage results from the fact that discarded partially smoked cigarettes will self-extinguish sooner than normal, resulting in less risk that they will provide a source of combustion to furniture or other flammables which they might come in contact with. Also, a cigarette left burning balanced on an ashtray will extinguish before the cigarette has burned to the point where it topples out of the ashtray, further reducing the fire hazard of cigarettes.

One embodiment of the present invention involves an electromagnetically actuated spray nozzle 35 in combination with the above described apparatus 10 and located as shown in FIG. 3. Spray nozzle 35 is placed through the wall of trough 15 just past ecreteur disk opening 21 and is positioned so that a liquid fire retardant can be sprayed in pulses upon the moving stream of trimmed tobacco before it enters the garniture and before the cigarette paper is applied to form the cigarette rod. Spray nozzle 35 is similar to the electromagnetic fuel injection nozzles used in automobile fuel systems. Nozzle 35 is connected to liquid line 36 which communicates with a source of pressurized fire retardant fluid (not shown), such as the aforementioned sodium silicate solution. An electromagnetic solenoid actuated valve within spray nozzle 35 enables the flow of pressurized fluid through the valve to be turned on and off rapidly by means of electrical signals sent to nozzle 35 via wires 37.

The electrical actuation signals sent to spray nozzle 35 via wires 37 are synchronized in timing and in duration with the garniture mechanism and the rotating knife 30 so that a proper amount of fluid is sprayed upon a short length of the moving tobacco such that the treated portion of the tobacco will fall at approximately the middle of each cigarette as it emerges from the rotating knife. Of course, the timing could be altered if it is desired to have the fire retardant applied other than at the middle of each cigarette length.

Figure 4:
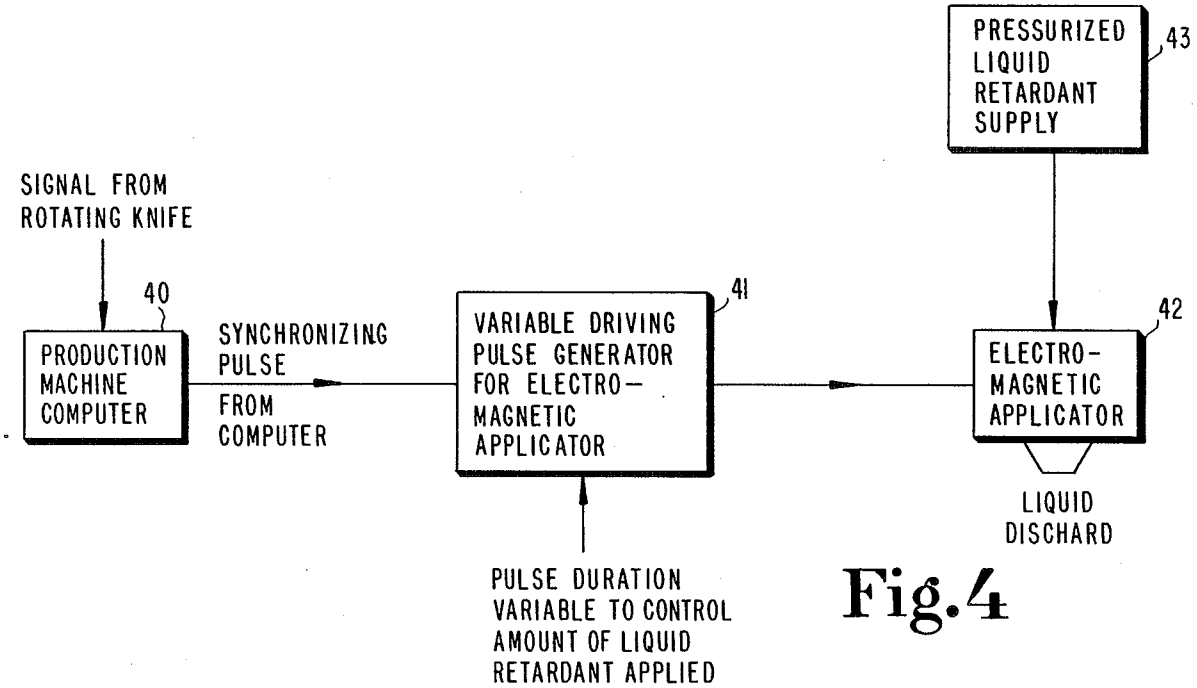
FIG. 4 is a block diagram of the control and synchronization circuitry of the apparatus of FIG. 1.

Inasmuch as automatic cigarette making machines such as the one described above are usually computer controlled, it is preferred that the timing and duration of the spray pulses be coordinated with the existing machine control system. FIG. 4 shows one general scheme by which the improvement of the present invention could be integrated with the control circuitry of an existing cigarette making machine. The production machine computer 40, acting in response to a signal from the rotating knife or other convenient timing point, would be programmed to provide a synchronizing pulse to a variable driving pulse generator 41, which would in turn provide pulses of proper spacing and duration to the electromagnetic applicator 42 (which corresponds to spray nozzle 35 in the preferred embodiment). Applicator 42 is of course in communication with a pressurized liquid retardant supply 43. The duration of the output pulse from pulse generator 41 is made variable and subject to external control.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What is claimed is:

1. An apparatus for making self-extinguishing cigarettes, comprising:

means for continuously gathering and arranging shredded tobacco particles into a substantially uniform moving stream of tobacco;

means for providing a continuous strip of cigarette wrapping paper;

means for continuously receiving said moving stream of tobacco and said continuous strip of cigarette wrapping paper and combining and shaping them into a continuous cigarette rod;

means for receiving said continuous cigarette rod and cutting said cigarette rod into individual cigarettes;

a supply of liquid fire retardant chemical;

means, in flow communication with said supply of liquid, for intermittently directing the flow of said liquid onto said moving stream of tobacco before the moving stream of tobacco reaches said continuous strip of cigarette wrapping paper; and means for synchronizing said intermittent flow means with said cigarette cutting means such that said liquid is applied at intervals and for a selected duration so that the portion of the tobacco stream to which the liquid is applied ends up at approximately the midpoint along the length of each cut cigarette.

2. An apparatus for making self-extinguishing cigarettes, comprising:

means for continuously gathering and arranging shredded tobacco particles into a substantially uniform moving stream of tobacco;

means for providing a continuous strip of cigarette wrapping paper;

means for continuously receiving said moving stream of tobacco and said continuous strip of cigarette wrapping paper and combining and shaping them into a continuous cigarette rod;

means for receiving said continuous cigarette rod and cutting said cigarette rod into individual cigarettes;

a supply of liquid fire retardant chemical;

means, including an electrically actuated nozzle in flow communication with said supply of liquid, for intermittently directing the flow of said liquid onto said moving stream of tobacco before said tobacco reaches the cigarette paper; and means for synchronizing said intermittent flow means with said cigarette cutting means such that said liquid is applied at intervals and for a selected duration so that the portion of the tobacco stream to which the liquid is applied ends up at a selected place along the length of each cut cigarette.

3. The apparatus of claim 2, wherein said alkali metal silicate is sodium silicate.

4. A process for treating tobacco to make a self extinguishing cigarette, comprising the steps of:

(1) gathering and arranging shredded tobacco particles into a substantially uniform moving stream of tobacco;

(2) providing a source of liquid fire retardant chemical;

(3) intermittently directing and applying said liquid onto said moving stream of tobacco for a selected duration;

(4) providing a continuous strip of cigarette wrapping paper, said directing and applying occurring before the moving stream of tobacco reaches said continuous strip of cigarette wrapping paper;

(5) continuously receiving, combining and shaping said moving steam of tobacco and said continuous strip of cigarette wrapping paper into a continuous cigarette rod; and (6) cutting said continuous cigarette rod into individual cigarettes in synchrony with the application of said liquid to said moving stream of tobacco such that the portion of the tobacco stream to which the liquid is applied ends up at approximately the midpoint along the length of each finished cigarette.

5. A process for treating tobacco to make self extinguishing cigarette, comprising the steps of:

(1) gathering and arranging shredded tobacco particles into a substantially uniform moving stream of tobacco;

(2) providing a source of liquid fire retardant chemical;

(3) intermittently directing and applying said liquid onto said moving stream of tobacco for a selected duration;

(4) providing a continuous strip of cigarette wrapping paper, said directing and applying occurring before the moving stream of tobacco reaches said continuous strip of cigarette wrapping paper;

(5) continuously receiving, combining and shaping said moving steam of tobacco and said continuous strip of cigarette wrapping paper into a continuous cigarette rod; and (6) cutting said continuous cigarette rod into individual cigarettes in synchrony with the application of said liquid to said moving stream of tobacco such that the portion of the tobacco stream to which the liquid is applied ends up at a selected place along the length of each finished cigarette.

6. The process of claim 5, wherein said alkali metal silicate is sodium silicate.

7. An apparatus for making self-extinguishing cigarette, comprising:

means for continuously gathering and arranging shredded tobacco particles into a substantially uniform moving stream of tobacco;

means for providing a continuous strip of cigarette wrapping paper;

means for continuously receiving said moving stream of tobacco and said continuous strip of cigarette wrapping paper and combining and shaping them into a continuous cigarette rod;

means for receiving said continuous cigarette rod and cutting said cigarette rod into individual cigarettes;

a supply of liquid fire retardant chemical;

means, in flow communication with said supply of liquid, for intermittently directing the flow of said liquid onto said moving stream of tobacco before it reaches the cigarette paper;

means for synchronizing said intermittent flow means with said cigarette cutting means such that said liquid is applied at intervals and for a selected duration so that the portion of the tobacco stream to which the liquid is applied ends up at approximately the midpoint along the length of each cut cigarette, said means for synchronizing including a production machine computer and a variable driving pulse generator.

8. The apparatus of claim 1 wherein said pulse generator is controllable to vary pulse duration to control the amount of liquid fire retardant chemical applied.

* * * * *